US006206089B1

(12) United States Patent
Uchikawa et al.

(10) Patent No.: US 6,206,089 B1
(45) Date of Patent: Mar. 27, 2001

(54) HEAT EXCHANGER AND METHOD FOR MANUFACTURING THE SAME

(75) Inventors: Akira Uchikawa, Nagoya; Yasutoshi Yamanaka, Kariya; Takaaki Sakane, Nagoya; Satomi Muto, Nishikasugai-gun; Homare Koutate, Nagoya, all of (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 08/958,577

(22) Filed: Oct. 28, 1997

(30) Foreign Application Priority Data

Oct. 29, 1996 (JP) ..... 8-287020
Nov. 1, 1996 (JP) ..... 8-291765
Oct. 6, 1997 (JP) ..... 9-273067

(51) Int. Cl.[7] ..... F28D 7/10
(52) U.S. Cl. ..... 165/109.1; 165/154; 165/916
(58) Field of Search ..... 165/109.1, 154, 165/156, 916

(56) References Cited

U.S. PATENT DOCUMENTS 3,732,921 5/1973 Hilicki et al. .
5,186,250 * 2/1993 Ouchi et al. ..... 165/177

FOREIGN PATENT DOCUMENTS 549653 4/1932 (DE) .
03071942 3/1991 (EP) .
0457470A1 11/1991 (EP) .
602968 * 6/1994 (EP) ..... 165/154
0732560A2 9/1996 (EP) .
1579275 11/1980 (GB) .
58-46969 U 9/1956 (JP) .
58-52462 U 4/1983 (JP) .
3-71943 3/1991 (JP) .
3-233129 10/1991 (JP) .

* cited by examiner

*Primary Examiner*—Allen Flanigan
(74) *Attorney, Agent, or Firm*—Harness, Dickey & Pierce, PLC

(57) ABSTRACT

According to the present invention, a first tube is constructed by connecting a plate material into a tubular shape. In the manufacturing process, after an inner fin is disposed around an outer wall of a second tube, the first tube is disposed around the second tube, and the first tube and the second tube are fixed by connecting the plate material in such a manner that the inner fin is in contact with the both tubes. In this way, the inner fin and both tubes are certainly contacted closely to each other without enlarging the second tube.

20 Claims, 7 Drawing Sheets

FIG. 11A
FIG. 11B
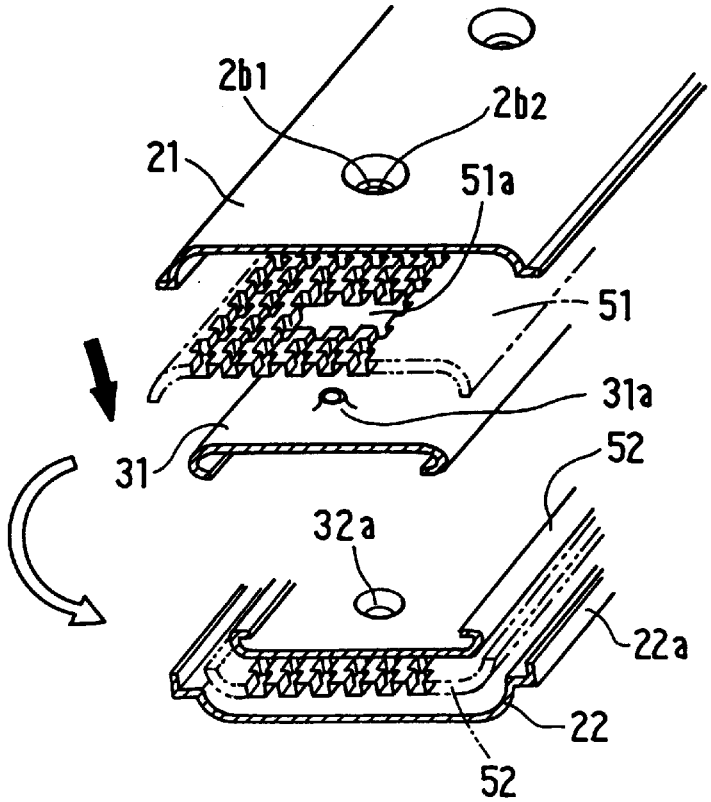
FIG. 12
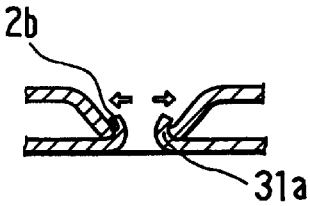
FIG. 13
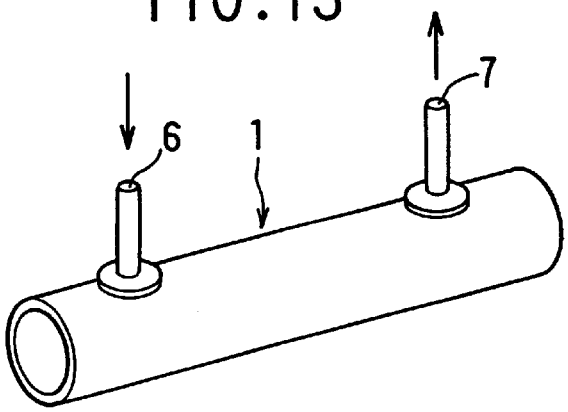

HEAT EXCHANGER AND METHOD FOR MANUFACTURING THE SAME

CROSS-REFERENCE TO RELATED APPLICATIONS

This application is based on Japanese Patent Applications of Nos. Hei. 8-287020 filed on Oct. 29, 1996, Hei. 8-291765 filed on Nov. 12, 1996, and Hei. 9-273067 filed on Oct. 6, 1997, filed on the contents of which are incorporated herein by reference.

BACKGROUND OF THE INVENTION

1. Field of the Invention

The present invention relates to a heat exchanger such as an oil cooler, having an outer cylindrical pipe (first tube) and an inner cylindrical pipe (second tube), for cooling engine oil, hydraulic oil (ATF) for an automatic transmission, or the like (hereinafter simply referred to as "oil").

2. Description of Related Art

An oil cooler having an outer cylindrical pipe and an inner cylindrical pipe is structured, as shown in JP-U-58-52462, such that a passage through which oil flows is formed between the outer cylindrical pipe and the inner cylindrical pipe and an inner fin is disposed in the passage. Generally, both pipes employ seamless pipes having no seam (connecting surface), which are produced by drawing or extruding, in view of mechanical strength, manufacturing cost, and the like.

To improve heat-exchange (cooling) efficiency, it is necessary to certainly contact the inner fin closely to both pipes. Therefore, generally, after the inner fin is inserted into the passage (gap), the inner cylindrical pipe is enlarged (this work is hereinafter referred to as "enlarging pipe work") by applying pressure from inside the inner cylindrical pipe before being brazed, so that the inner fin certainly contacts both pipes closely.

However, the enlarging pipe work needs a specific jig thereof. In addition, it is difficult to enlarge the inner cylindrical pipe uniformly; and therefore, a reduction of manufacturing cost of the oil cooler is disturbed.

Further, it is actually difficult to inspect whether or not the inner fin certainly contacts both pipes closely after the enlarging pipe work is finished. Therefore, when the enlarging pipe work is improper, the inner fin and both pipes may be brazed to each other while forming a gap therebetween, and a deterioration of the heat-exchange efficiency and the durability may be caused.

SUMMARY OF THE INVENTION

The present invention has been accomplished in view of the above-mentioned problem, and an object of the present invention is to abolish the enlarging pipe work and to certainly contact the inner fin and both pipes closely.

According to the present invention, a first tube is formed by connecting a plate material.

In this way, when the plate material is connected, a first tube and a second tube are certainly contacted to an inner fin closely without enlarging the second tube. Therefore, because it is not necessary to enlarge the second tube, deterioration of heat exchanging efficiency and durability due to the improper work for enlarging the second tube can be prevented, with the result that the manufacturing cost of the heat exchanger can be reduced.

BRIEF DESCRIPTION OF THE DRAWINGS

Additional objects and advantages of the present invention will be more readily apparent from the following detailed description of preferred embodiments thereof when taken together with the accompanying drawings in which:

FIGS. 11A and 11B are disassembled perspective views of an oil cooler according to a third embodiment of the present invention;

FIG. 12 is an explanatory view of a hole portion of a first tube and a burring portion of a second tube according to the third embodiment;

FIG. 13 is a perspective view showing an oil cooler having a round tube.

DETAILED DESCRIPTION OF THE PREFERRED EMBODIMENTS

Embodiments according to the present invention will be described hereinafter with reference to the drawings.

A first embodiment of the present invention will be described.

Figure 1A:
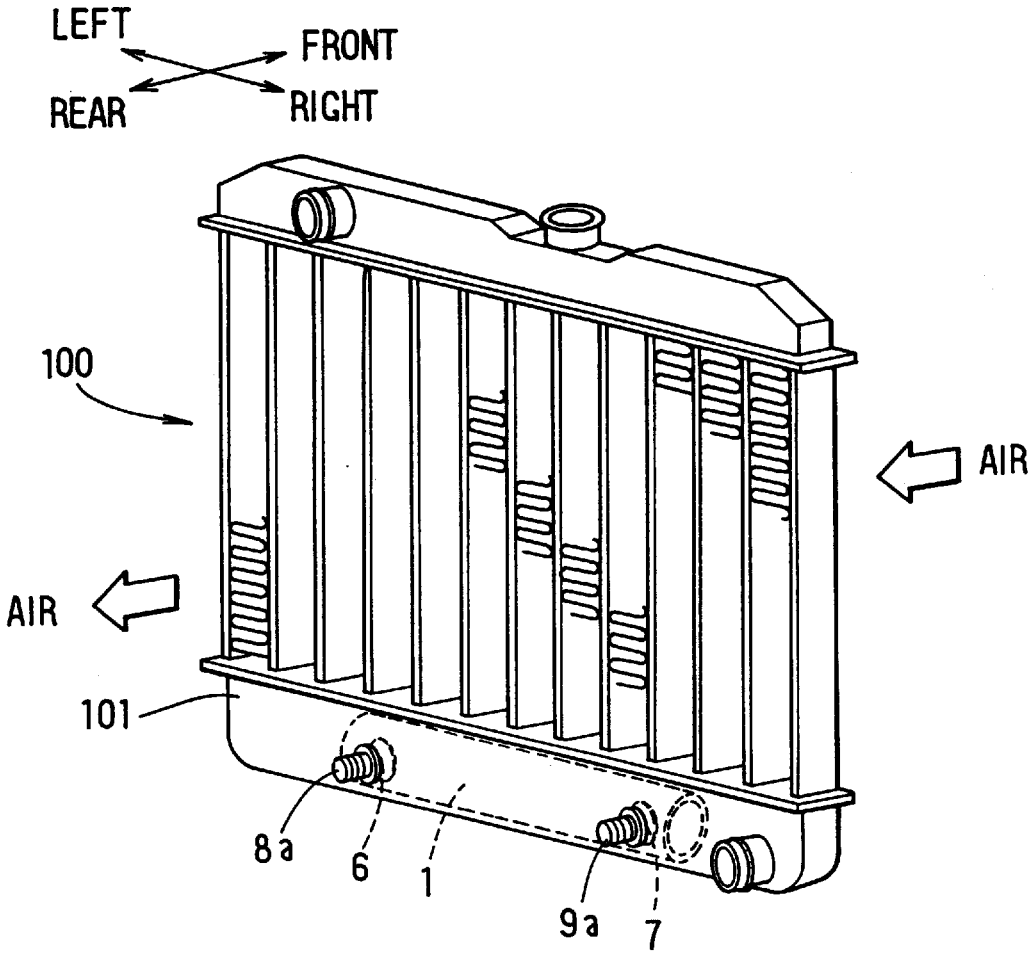
FIG. 1A is a perspective view showing an oil cooler according to a first embodiment of the present invention disposed in a tank of an oil cooler.
Figure 1B:
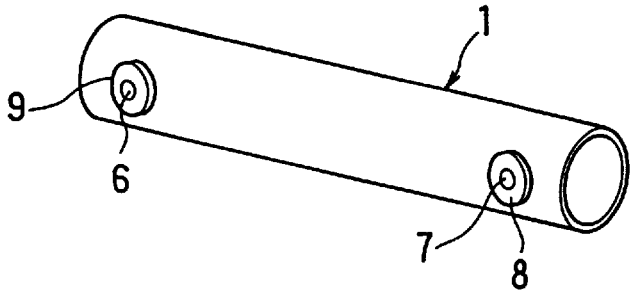
FIG. 1B is a perspective of the oil cooler according to the first embodiment.

In this embodiment, an exchanger according to the present invention is applied to oil cooler for cooling an engine oil lubricating an engine (not shown), hydraulic oil (ATF) for an automatic transmission, or the like (hereinafter simply referred to as "oil"). As shown in FIG. 1A, the oil cooler 1 is disposed in a tank 101 of a radiator 100 for cooling engine cooling water in such a manner that a longitudinal direction thereof is consistent with a longitudinal direction of the tank 101. FIG. 1B is an enlarged view of the oil cooler 1.

Figure 2:
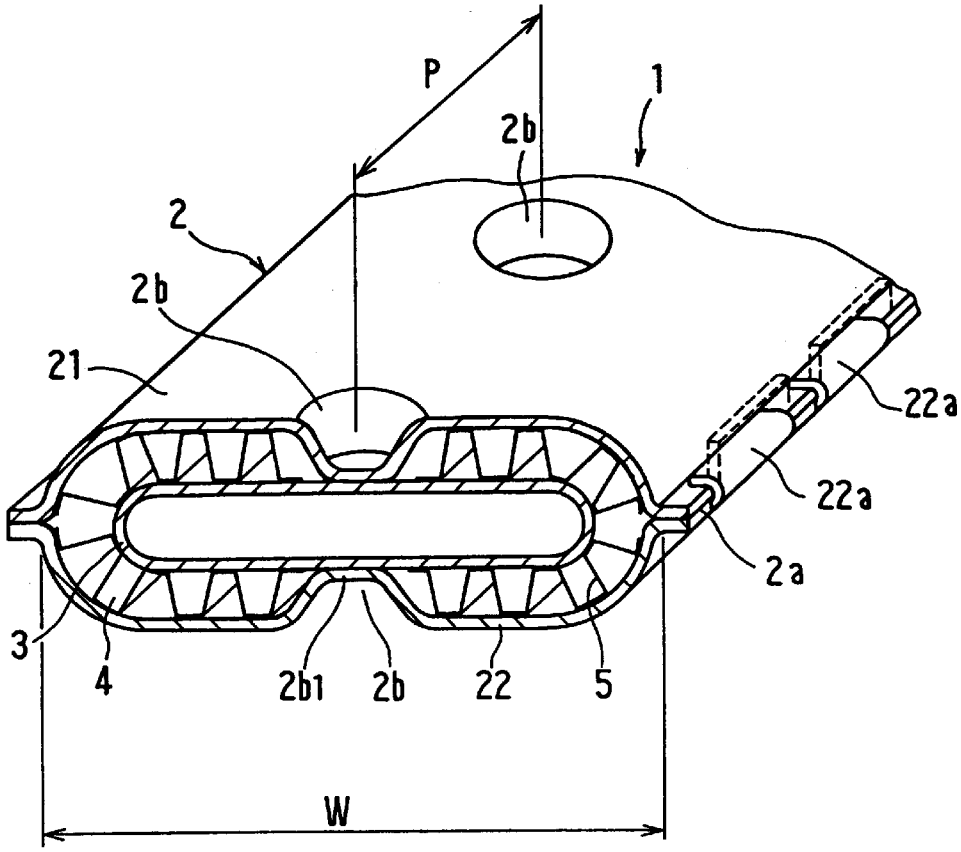
FIG. 2 is a cross sectional view of the oil cooler in a transverse direction according to the first embodiment.

FIG. 2 shows a cross section in a direction perpendicular to the longitudinal direction of the oil cooler 1 of the embodiment (a cross section in a transverse direction). In a first tube (outer cylindrical pipe) 2 formed in a flat shape, a second tube (inner cylindrical pipe) 3, a longitudinal direction of which is consistent with the first tube 2, is disposed.

The first tube 2 is constructed by a first plate 2 and a second plate 22, which are formed into predetermined shapes by pressing plate materials made of aluminum. A connection portion (first connection portion) 2*a* for connecting both plates 21 and 22 extends in the longitudinal direction of the first tube 2. The second tube 3 is a seamless tube having no seam (connection portion), which is produced by drawing or extruding.

Figure 3:
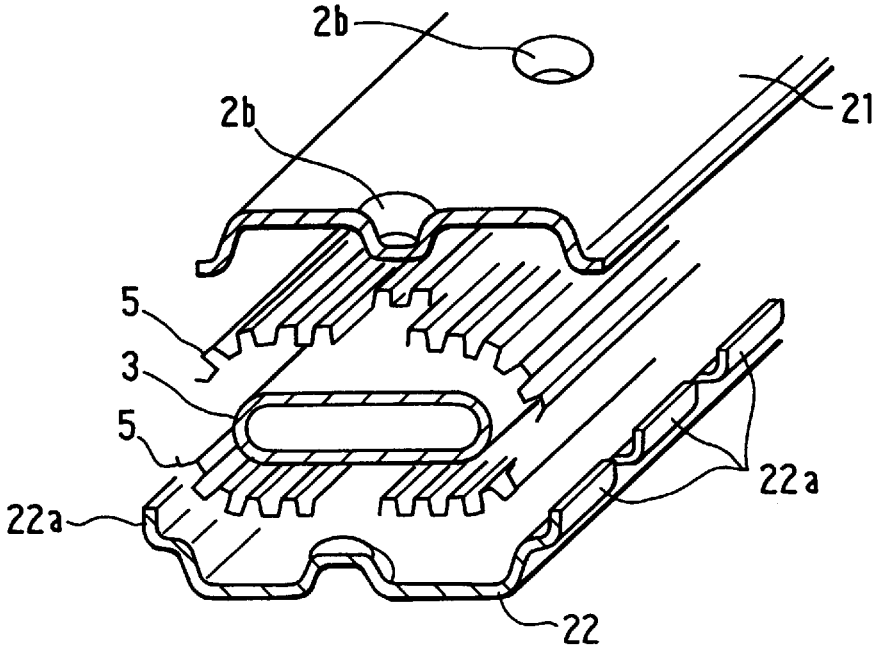
FIG. 3 is a disassembled perspective view of the oil cooler according to the first embodiment.

At end portions in the transverse direction of the second plate 22, of the connection portion 2*a* of the second plate 22, as shown in FIG. 3, there are formed protrusions (crimp portions) 22*a* at a left-right side of the paper sheet (only right side is shown), which protrude toward the first plate 21. The crimp protrusions are folded toward the first plate 21 and plastically deformed so that both plates are fixed to each other by crimping.

As shown in FIG. 2, between both tubes 21 and 22, there is formed a passage 4 through which the oil (fluid) flows. In the passage 4, there is disposed an offset type inner fin 5 in contact with both tubes 21 and 22 to facilitate heat-exchange (cooling) of the oil.

Each wall surface of the first tube 2 (both plates 21 and 22) and the second tube 3 is covered with a brazing material having a melting point lower than that of the aluminum. By the brazing material, the connection portions 2*a* of both plates 21 and 22 are connected, and both tubes 2 and 3 and the inner fin 5 are connected.

In this embodiment, both tubes 2 and 3 are connected with the inner fin therebetween. As shown in FIG. 2, both tubes 2 and 3 are directly connected in the passage 4 by a concave portion (second connection portion) 2*b* formed in the first tube 2. A plurality of the concave portions (dimples) 2*b* stand in a line in series in the longitudinal direction of the first tube 2 while being depressed toward the second tube 3. Each bottom $2b_1$ of the concave portions 2*b* are connected to the second tube 3. The concave portions 2*b* are integrally formed with both plates 21 and 22 by pressing.

As shown in FIG. 1B, there are formed an inflow port 6 through which the oil introduced from the engine into the passage 4 and an outflow port 7 through which the cooled oil flows out.

Next, a method for manufacturing the oil cooler according to the embodiment will be described.

Figure 4A:
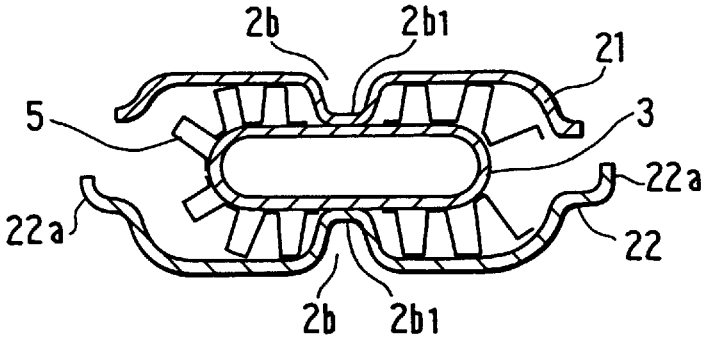
FIG. 4 is an explanatory view showing a manufacturing process of the oil cooler according to the first embodiment.

First, an inner fin 5 is disposed around the outer wall of the second tube 3 (first process), and the bottom portions $2b_1$ of the concave portions 2*b* are connected to the second tube 3 by spot welding (see FIG. 4).

Figure 4B:
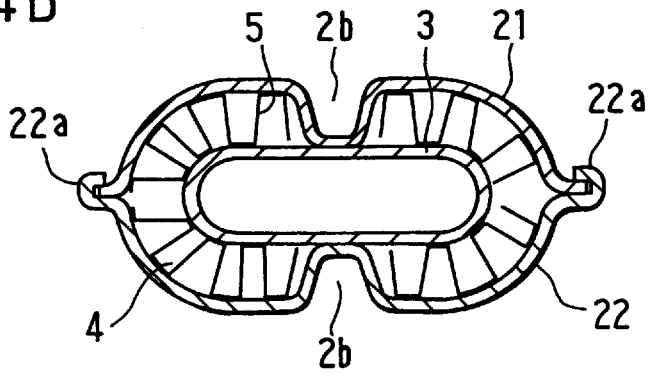

Next, both plates 21 and 22 are contacted closely to the inner fin 5 in such a manner that the second tube 3 and the inner fin 5 are sandwiched from a vertical direction of the paper sheet, and the crimp protrusions 22*a* are folded, so that both plates 21 and 22 are fixed by crimping (FIG. 4B). Both plates 21 and 22, the second tube 3, and the inner fin 5 are brazed to one another while being heated in a furnace (second process).

In this embodiment, the concave portions 2*b* and the second tube 3 are connected by welding; however, the bottom portions $2b_1$ of the concave portions 2*b* are partially pressed by a punch or the like to such an extent that a cracking is not generated thereon, so that the concave portions 2*b* and the second tube 3 may be fixed easily by crimping.

Next, features of the present invention will be described.

According to the embodiment, because the first tube 2 is formed by connecting the first plate 21 and the second plate 22, when both plates 21 and 22 are connected, both tubes 2 and 3 are certainly contacted to the inner fin 5 closely. Therefore, it is not necessary to perform the enlarging pipe work after both tubes 2 and 3 and the inner fin 5 are temporarily assembled. Accordingly, it is possible to prevent the deterioration of the heat-exchange efficiency and the durability due to the improper enlarging pipe work. In addition, the yield of the oil cooler 1 can be improved, and the number of the manufacturing processes can be reduced, with the result that the manufacturing cost of the oil cooler 1 can be reduced.

Even if a defective brazing is caused due to a faulty contact (gap) between both tubes 2 and 3 and the inner fin 5, because both tubes 2 and 3 are directly connected by the concave portions 2*b*, it is possible to prevent the durability of the oil cooler 1 from lowering excessively. Therefore, the reliability and the durability of the oil cooler 1 can be improved.

As in this embodiment, when the shape of the tube is flat, a bending stress is applied to both tubes 2 and 3 by the pressure in the passage 4, in addition to the simple tensile stress. In this embodiment, because both tubes 2 and 3 are connected substantially at a center of the width direction (the large diameter direction of the flat shape) of both tubes 2 and 3, it is possible to effectively improve the durability of both tubes 2 and 3.

As being apparent from the above description, if the number of the concave portions 2*b*, i.e., the number of the connection portions for directly connecting between both tubes 2 and 3, is increased the durability of the oil cooler 1 can be improved.

However, the durability is not determined only by the number of the concave portions 2*b* but varies by thicknesses of the both tubes 2 and 3, the size W in the width direction of the tube (see FIG. 2), and the like. Further, if the number of the concave portions 2*b* is increased simply, the number of processes for connecting the concave portion 2*b* to the second tube 3 increases, with the result that the manufacturing cost of the oil cooler 1 may increase. Therefore, it is necessary to determine the number of the concave portions 2*b* while being in harmony with the durability and the manufacturing cost.

The inventors have examined the number of the concave portions 2*b* by using an average thickness of the tube in the oil cooler for a vehicle. As a result, it comes to the conclusion that a distance (pitch) P between the concave portions 2*b* is preferably 70%–200% of the size W in the width direction. In this embodiment, each thickness of both tubes 2 and 3 is 0.6 mm, the size W in the width direction is 35 mm, and the pitch P is 35 mm.

Further, in this embodiment, because the concave portions 2*b* are connected to the second tube 3 before both plates 21 and 22 are fixed by crimping, the inner fin 5 is pressed by both plates 21 and 22 toward the second tube 3, and the inner fin 5 is temporarily fixed to the second tube 3.

Therefore, when both tubes 21 and 22 are fixed by crimping, it is prevented that the inner fin 5 moves (is displaced), so that a gap can be prevented from being formed between the inner fin 5 and both tubes 2 and 3. Accordingly, the yield of the oil cooler 1 can be improved, and the manufacturing cost can be reduced.

Further, because both plates 2 and 3 are fixed by crimping before being brazed, it is not necessary to temporarily fix both plates 2 and 3 by a jig or the like. Therefore, the oil cooler 1 can be disposed in a furnace without being bound by the jig, and a large number of the oil coolers can be brazed per one brazing process as compared with when the oil cooler is bound by the jig. As a result, the manufacturing cost of the oil cooler 1 can be reduced.

Figure 5:
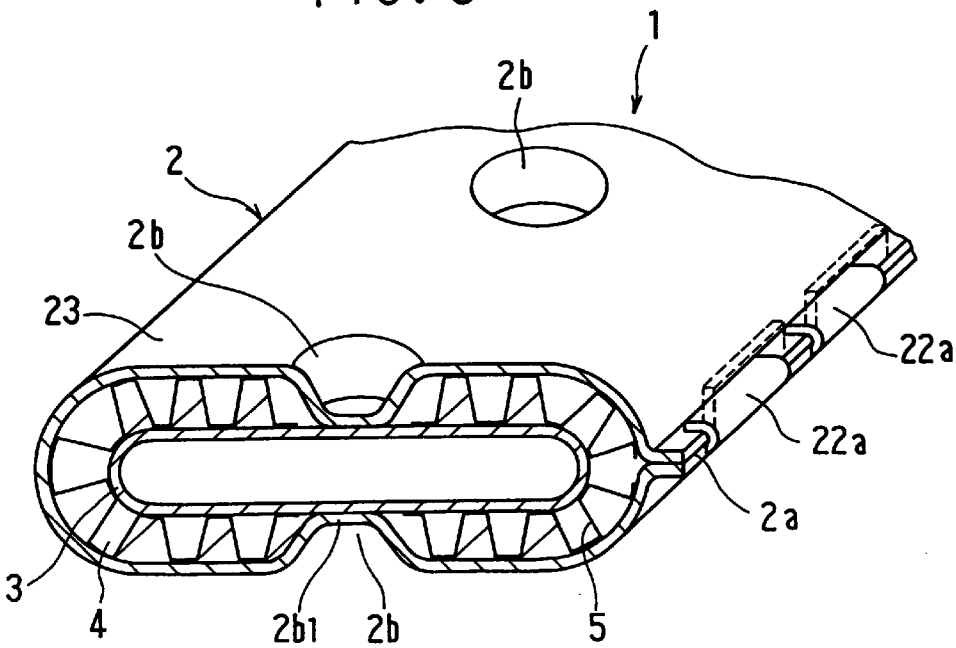
FIG. 5 is a cross sectional view showing a modification of the present invention.

In the above-described embodiment, the first tube 2 is constructed by the first and second plates 21 and 22; however, as shown in FIG. 5, the first tube may be constructed by folding a single plate 23.

Further, the process for fixing both plates 21 and 22 by crimping (crimp protrusion 22*a*) may be abolished. However, in this case, it is necessary to braze both plates 21 and 22 while being temporarily fixed by a jig or the like.

In the above-described embodiment, the process for connecting the concave portions 2*b* is performed before the process for fixing both plates 21 and 22 by crimping; however, this process is abolished, and the concave portions 2*b* may be brazed simultaneously in the process for brazing both tubes 2 and 3 and the inner fin 5.

In the above-described embodiment, the concave portions 2*b* are provided in the first tube 2, and both tubes 2 and 3 are directly connected to each other; however, convex portions protruding toward the first tube 2 are provided on the second tube 3, top ends of the convex portions may be connected to the first tube 2. Further, the top ends of the convex portions and the bottom portions $2b_1$ may be respectively connected.

In the above-described embodiment, the concave portions 2*b* are formed in a line in series in the longitudinal direction of the first tube 2; however, the present invention is not limited thereto, but the concave portions 2*b* may be formed alternately.

A second embodiment of the present invention will be described with reference to FIGS. 6A to 8B.

In the second embodiment, parts and components similar to those in the first embodiment are shown with the same reference numerals.

Figure 6A:
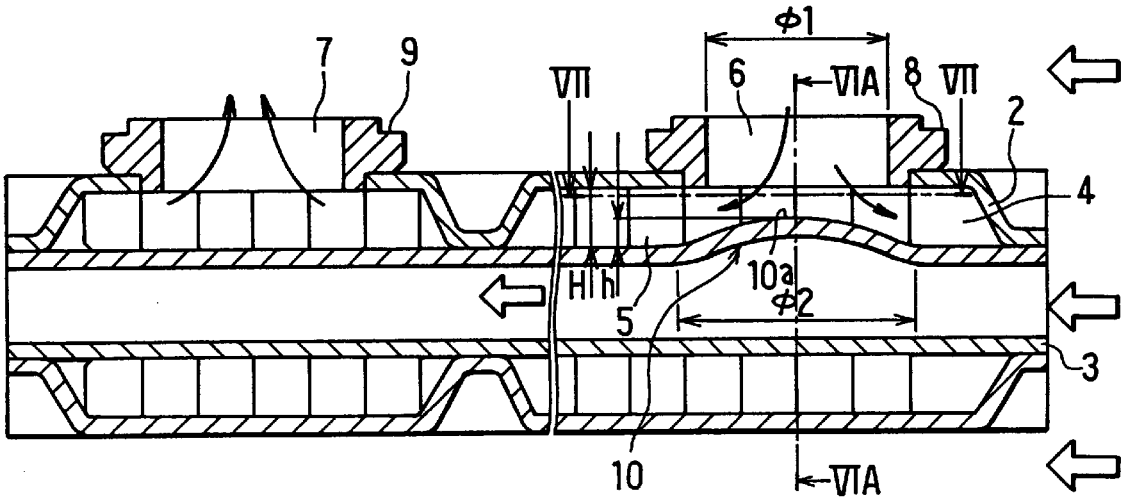
FIG. 6A is a cross sectional view in a longitudinal direction of an oil cooler according to a second embodiment of the present invention.
Figure 6B:
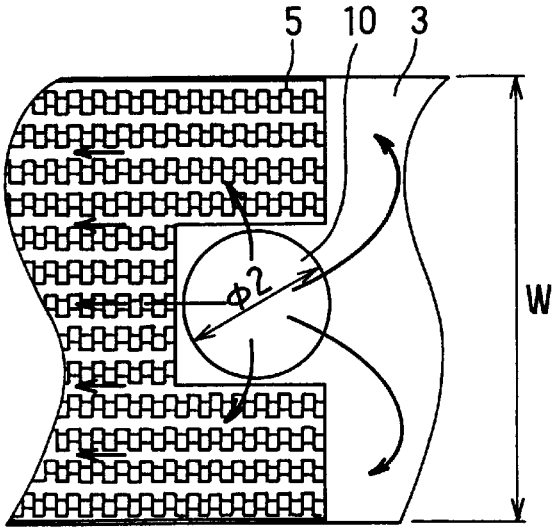
FIG. 6B is a cross sectional view taken along the line VII—VII of FIG. 6A.
Figure 7:
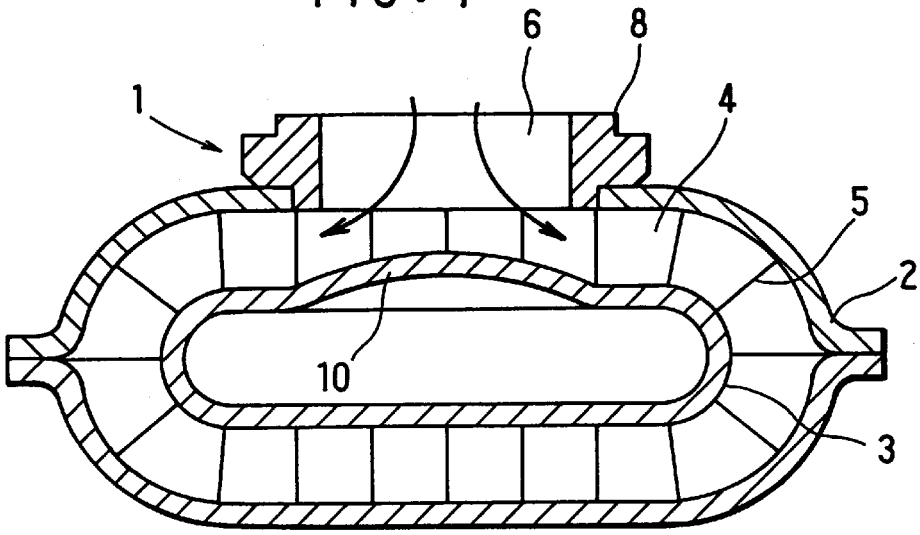
FIG. 7 is a cross sectional view taken along the line VIA—VIA of FIG. 6A FIGS. 8A and 8B are explanatory views showing a diffusion space formed in a passage.

In FIGS. 6A and 6B, an inflow port 6 for introducing the oil discharged from the engine into the passage 4 is formed at one end of the passage 4, and an outflow port 7 through which cooled oil flows out toward the engine is formed at the other end of the passage 4. The inflow port 6 and the outflow port 7 are open in a direction perpendicular to the longitudinal direction of the passage 2, i.e., toward the rear side of the vehicle.

Brackets 8 and 9 made of aluminum are brazed to the first tube 2 and form the inflow port 6 and the outflow port 7, respectively, to fix the oil cooler 1 in the tank 101 of the radiator 100. Joint portions 8*a* and 9*a* to be connected to oil pipes (not shown) from the engine are connected to the brackets 8 and 9 from the outside of the tank 101 of the radiator 100.

At least at a portion of the second tube 3, facing the inflow port 6, as shown in FIGS. 6A and 6B, there is formed a protrusion portion 10 protruding (elevated) toward the inflow port 6 in a spherical shape, integrally with the second tube 3. A spherical surface 10*a* of the protrusion portion 10 constructs a deflection wall for deflecting the oil having flowed from the inflow port 6 into a direction having a component in an opposite direction with the outflow port 7. The direction having a component in an opposite direction with the outflow port 7 is of a direction which is different from a main flow of the oil in the passage 4 and of a direction where the oil is diffused entirely in the passage 4. The inner fin 5 is not disposed at an end portion of the passage 4 and a portion where the protrusion portion 10 is formed.

An opening diameter $\phi_1$ of the inflow port 6 is substantially equal to a diameter $\phi_2$ of the protrusion portion 10 at a lower side thereof. Considering the brazing performance and assembling performance of the brackets 8 and 9 into the first tube 2, the diameter $\phi_2$ is smaller than the size W in the width direction (the size in a direction perpendicular to the longitudinal direction of the passage 4).

Next, features of this embodiment will be described.

According to this embodiment, the oil flowing from the inflow passage 6 is deflected into the direction having the component in the opposite direction with the outflow port 7, as shown in FIGS. 6A and 6B, and the oil is diffused entirely in the passage 4, so that the oil can be distributed entirely in the passage 4. In FIG. 6A, a flow of the oil is shown by large arrows.

In this embodiment, as described above, because the oil is diffused entirely in the passage 4 to improve the cooling efficiency of the oil cooler 1, if the position of the protrusion portion 10 is improper, it is difficult to improve the cooling efficiency sufficiently. As a result of various examinations by the inventors, it comes to the conclusion that a top end portion of the protrusion portion 10 is preferably positioned at a portion in correspondence with a center of the outflow port 6.

Further, if the length of the protrusion portion 10 (the distance from the second tube 3 to the top portion of the protrusion portion) is large, pressure loss (flow resistance) when the oil passes is large, with the result that the cooling efficiency may be deteriorated.

As a result of further examinations by the inventors, to improve the cooling efficiency without causing the increase of the large pressure loss, it comes to the conclusion that a protrusion length h is preferably equal to or less than 50% of a height (size of the inner diameter of the passage 4 parallel to the protruding direction of the protrusion portion 10) H of the inner diameter of the passage 4.

Figure 8A:
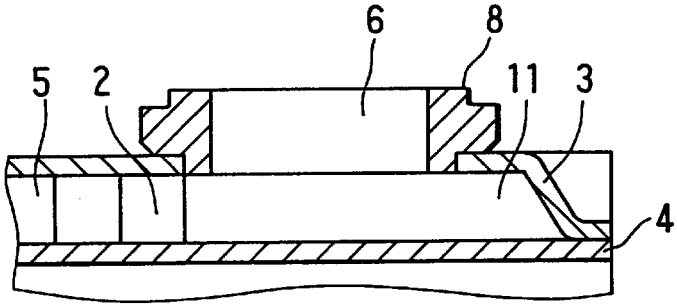
Figure 8B:
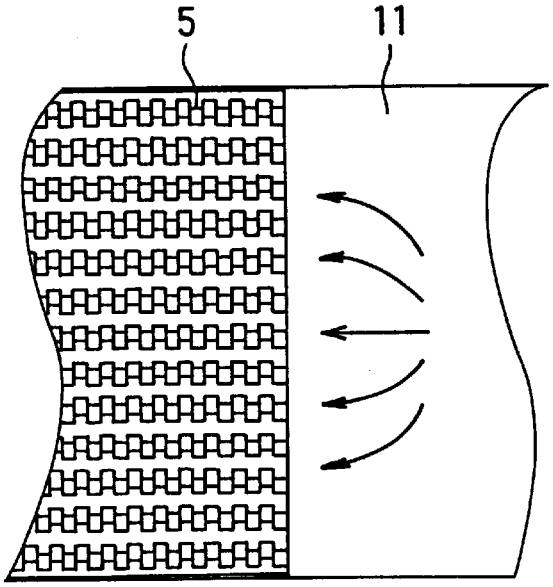

As means for diffusing the oil flowing from the inflow port 6 entirely into the passage 4, as shown in FIGS. 8A and 8B, a diffusion space 11 having no inner fin 5 may be formed at a portion in the passage 4, in correspondence with the inflow port 6. However, in such a construction, there occur another problems that a total surface area of the inner fin 5 decreases and a connecting force for connecting between both tubes 2 and 3 through the inner fin 5 lowers to deteriorate the pressure resistance.

In contrast, according to this embodiment, because it is not necessary to provide the diffusion space 11, the above-described problems do not occur, so that the cooling efficiency of the oil cooler 1 can be improved.

Further, by employing the simple construction in which the protrusion portion 10 is integrally formed with the second tube 3, the cooling efficiency of the oil cooler 1 can be improved. Therefore, the increase of the manufacturing cost of the oil cooler 1 according to the improvement of the cooling efficiency can be improved.

If the inner fin 5 is disposed at the portion where the protrusion portion 10 is formed, the cross section of the passage 4 is reduced by the protrusion portion 10, and the pressure loss by the inner fin 5 increases, with the result that the cooling efficiency of the oil cooler 1 may deteriorate. In this embodiment, because the inner fin 5 is not disposed at the portion where the protrusion portion 10 is formed, the pressure loss in the passage 4 can be prevented from increasing excessively.

Further, in this embodiment, the inner fin 5 is not disposed at the end portion of the passage 4 to avoid the concave portion 2*b* connected to the second tube 3.

Figure 9A:
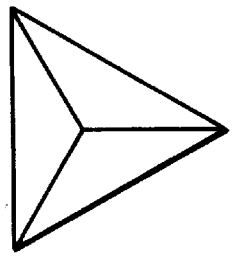
FIGS. 9A and 9B show a modification of a protrusion portion.
Figure 9B:
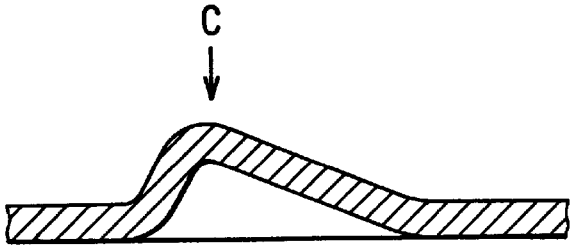
Figure 10A:
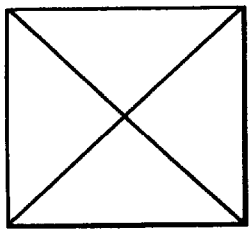
FIGS. 10A and 10B show another modification of a protrusion portion.
Figure 10B:
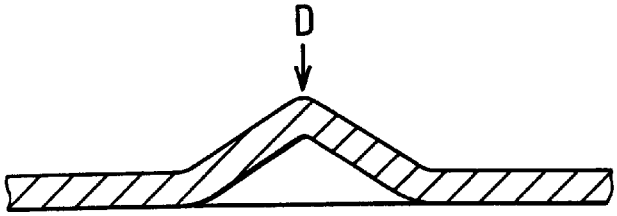

In the above-described embodiment, the deflection wall is constructed by the spherical surface 10*a* of the protrusion portion 10; however, the protrusion portion 10 may be formed in a trigonal pyramid (see FIGS. 9A and 9B) or a quadrangular pyramid (see FIGS. 10A and 10B).

In the above-described embodiment, the oil cooler 1 is disposed in the tank 101 of the radiator 1; however, the oil cooler 1 may be disposed in an engine.

A third embodiment of the present invention will be described.

As shown in FIGS. 11A and 11B, the second tube 3 is constructed by two separate plates 31 and 32, and the inner fin 5 is constructed by two inner fins 51 and 52. In both plates 31 and 32, there are formed protrusions 31*a* and 32*a* protruding toward the first tube 2, in correspondence to the bottom portion $2b_1$ of the first tube 2. The bottom portion $2b_1$ has a hole portion $2b_2$ for receiving the protrusion 31*a* through a hole portion 51*a* formed in the inner fin 5.

The outer plate 21 and the inner plate 31 are assembled as a first assembly in such a manner that the protrusion 31*a* is inserted into the hole portion $2b_2$ of the bottom portion $2b_1$, and then the protrusion 31*a* and the hole portion $2b_2$ are liquid-tightly connected by enlarging the protrusion 31*a* outwardly as shown in FIG. 12. Each size of the protrusion 31*a* and the hole portion $2b_2$ are set in advance to be in contact closely with each other when connected. The protrusion 31*a* and the hole portion $2b_2$ may be connected by crimping or welding. Similarly, the outer plate 22 and the inner plate 32 are assembled as a second assembly to construct the oil cooler 1. Next, the first assembly and the second assembly are assembled by crimping the connection portion 22*a*.

According to this embodiment, because the second tube 3 is constructed by separate plates 31 and 32, it is easy to manufacture the plates 31 and 32 by pressing, with the result that the manufacturing cost of the second tube 3 can be reduced as compared with when the pipe material (which is produced by extruding or an electric resistance welded tube) is employed. Further, it is possible to assemble the oil cooler 1 in one direction.

Further, the present invention is not limited to an oil cooler having a flat tube but may be embodied for an oil cooler having a tube of the other shapes, such as a round tube and a polygonal tube. In FIG. 13, the oil cooler 1 has a round tubular shape.

Although the present invention has been fully described in connection with the preferred embodiments thereof with reference to the accompanying drawings, it is to be noted that various changes and modifications will become apparent to those skilled in the art. Such changes and modifications are to be understood as being included within the scope of the present invention as defined in the appended claims.

What is claimed is:

1. A heat exchanger, comprising:

a first flat shaped tube formed by a plate material, said first flat shaped tube having a first connection portion located on a narrower side of said first flat shaped tube and extending in a longitudinal direction thereof, for connecting an end portion of the plate material;

a second flat shaped tube disposed in said first flat shaped tube, in parallel with said first flat shaped tube, to form a passage therewith, through which a fluid passes;

an inner fin disposed in said passage in contact with a wider side of said first flat shaped tube and a wider side of said second flat shaped tube, said inner fin being for facilitating a heat-exchange of the fluid; and a second connection portion extending generally perpendicular to said longitudinal direction on at least one of the wider sides of said first and second flat shaped tubes, said second connection portion being directly connected to the other of said first and second flat shaped tubes.

2. A heat exchanger according to claim 1, wherein said first connecting portion has a crimped portion for fixing said end portion of the plate material by crimping.

3. A heat exchanger according to claim 1, wherein said first tube is formed by connecting two plate materials into a flat cylindrical shape.

4. A heat exchanger according to claim 1, further comprising:

means for forming an inflow port at one end in a longitudinal direction of the passage, for introducing the fluid into said passage, said inflow port being open in a direction substantially perpendicular to the longitudinal direction of said passage;

means for forming an outflow port at the other end in the longitudinal direction, through which the fluid in the passage flows out; and a deflection member disposed in said passage, for deflecting the fluid flowing from said inflow port into a direction having a component in an opposite direction to said outflow port.

5. A heat exchanger according to claim 4, wherein said deflection member is disposed to face said inflow port.

6. A heat exchanger according to claim 4, wherein said deflecting member includes a protrusion portion protruding from an outer wall of said first tube toward said inflow port.

7. A heat exchanger according to claim 6, wherein said protrusion portion has a top end portion positioned in correspondence with a center of said inflow port.

8. A heat exchanger according to claim 6, wherein said protrusion portion has a protrusion length being equal to or less than 50% of an inner diameter of said passage, parallel to a protrusion direction of said protrusion portion.

9. A heat exchanger according to claim 1, wherein:

said first flat shaped tube has flat portions defining said wider side; and said second flat shaped tube and said inner fin are stacked between said flat portions in such a manner that said inner fin is in contact with both said first flat shaped tube and said second flat shaped tube when said first and second connection portions are connected.

10. A heat exchanger according to claim 1, wherein said second connection portion protrudes from at least one of said wider sides of said first and second flat shaped tubes.

11. A heat exchanger comprising:

a first flat shaped tube formed by a first material, said first flat shaped tube having a first connection portion located on a narrower side of said first flat shaped tube and extending in a longitudinal direction thereof, for connecting an end portion of the first plate material;

a second flat shaped tube disposed in said first flat shaped tube, in parallel with said first flat shaped tube, to form a passage therewith, through which a fluid passes, said second flat shaped tube being formed by connecting an end portion of the second plate material;

an inner fin disposed in said passage in contact with a wider side of said first flat shaped tube and a wider side of said second flat shaped tube, said inner fin being for facilitating the heat-exchange of the fluid; and a second connection portion extending generally perpendicular to said longitudinal direction on at least one of the wider sides of said first and second flat shaped tubes, said second connection portion being directly connected to the other of said first and second flat shaped tubes.

12. A heat exchanger according to claim 11, wherein, said first material has a hole portion, said second material has a protrusion portion, and, said protrusion portion is fixedly connected into said hole portion in such a manner that said inner fin is sandwiched between said first tube and said second tube.

13. A heat exchanger according to claim 11, wherein, said first tube are formed by connecting two first materials, said second tube are formed by connecting two second materials, said inner fin is constructed by a first and a second inner fins, and said first inner fin is sandwiched between a pair of said first plate and said second plate and said second inner fin is sandwiched between the other pair of said first plate and said second plate.

14. A heat exchanger according to claim 11, wherein:

said first flat shaped tube has flat portions defining said wider side, and said second flat shaped tube and said inner fin are stacked between said flat portions in such a manner that said inner fin is in contact with both said first flat shaped tube and said second flat shaped tube when said first and second connection portions are connected.

15. A heat exchanger comprising:

a first flat shaped tube formed by a plate material, said first flat shaded tube having a first connection portion located on a narrow side of said first flat shaped tube, said first connection portion securing an end portion of the plate material to form a chamber;

a second flat shaped tube disposed within said chamber to form a passage located between said first and second flat shaped tubes;

an inner fin disposed within said passage, said inner fin contacting a wider side of said first flat shaped tube and a wider side of said second flat shaped tube when said first connection portion secures the end portion of the plate material; and a second connection portion extending generally perpendicular to said longitudinal direction on at least one of the wider sides of said first and second flat shaped tubes, said second connection portion being directly connected to the other of said first and second flat shaped tubes.

16. A heat exchanger according to claim 15, further comprising:

means for forming an inflow port at one end in a longitudinal direction of the passage, for introducing the fluid into said passage, said inflow portion being open in a direction substantially perpendicular to the longitudinal direction of said passage;

means for forming an outflow port at the other end in the longitudinal direction, through which the fluid in the passage flows out; and a deflection member disposed in said passage, for deflecting the fluid flowing from said inflow port into a direction having a component in an opposite direction to said outflow port.

17. A heat exchanger according to claim 16, wherein said deflection member is disposed to face said inflow port.

18. A heat exchanger according to claim 16, wherein said deflecting member includes a protrusion portion protruding from an outer wall of said first tube toward said inflow port.

19. A heat exchanger according to claim 18, wherein said protrusion portion has a top end portion positioned in correspondence with a center of said inflow port.

20. A heat exchanger according to claim 18, wherein said protrusion portion has a protrusion length being equal to or less than 50% of an inner diameter of said passage, parallel to a protrusion direction of said protrusion portion.

* * * * *